US007537000B2

(12) United States Patent
Ideguchi et al.

(10) Patent No.: US 7,537,000 B2
(45) Date of Patent: May 26, 2009

(54) ENGINE WITH BREATHER APPARATUS

(75) Inventors: Takahiro Ideguchi, Wako (JP); Koichi Asai, Wako (JP); Toshikazu Nakamura, Wako (JP); Ryo Saito, Wako (JP); Katsuhiro Nakagawa, Wako (JP); Yasushi Fujita, Wako (JP)

(73) Assignee: Honda Motor Co., Ltd, Tokyo (JP)

( * ) Notice: Subject to any disclaimer, the term of this patent is extended or adjusted under 35 U.S.C. 154(b) by 0 days.

(21) Appl. No.: 11/702,518

(22) Filed: Feb. 6, 2007

(65) Prior Publication Data

US 2007/0186913 A1 Aug. 16, 2007

(30) Foreign Application Priority Data

Feb. 14, 2006 (JP) ..... 2006-037087
Feb. 14, 2006 (JP) ..... 2006-037088
Feb. 22, 2006 (JP) ..... 2006-045184

(51) Int. Cl.
*F02G 5/00* (2006.01)
*F02B 25/06* (2006.01)

(52) U.S. Cl. ..... 123/572; 123/543

(58) Field of Classification Search ..... 123/572–574, 123/543, 546, 549, 556, 557
See application file for complete search history.

(56) References Cited

U.S. PATENT DOCUMENTS 6,044,829 A * 4/2000 Butz et al. ..... 123/573
6,062,206 A * 5/2000 Nelson et al. ..... 123/573
7,387,114 B2 * 6/2008 Gschwind et al. ..... 123/573
2006/0144376 A1 * 7/2006 Gschwind et al. ..... 123/573

FOREIGN PATENT DOCUMENTS

DE 10237762 A1 * 2/2004
DE 10325965 A1 * 12/2004
EP 1 375 997 A1 1/2004
EP 001433994 A1 * 6/2004
EP 1 515 010 A1 3/2005

(Continued)

OTHER PUBLICATIONS

Chinese Office Action dated Jan. 9, 2009, issued in corresponding Chinese Application No. 20071007916.4.

*Primary Examiner*—Hai H Huynh
(74) *Attorney, Agent, or Firm*—Westerman, Hattori, Daniels & Adrian, LLP.

(57) ABSTRACT

In order to suppress freezing of a water content within a breather tube, a heater (13) is arranged within a breather tube (11) joining a cylinder head cover (10) and an air cleaner (8). A main body of the breather tube (11) is constituted by a joint tube (18) arranged in a middle, and partial tubes (22, 23) connected to both ends thereof. The heater (13) has a heating element (14) corresponding to a heating element, and has a heater case (21) accommodating the heating element (14) in a state of being pinched by electrodes (15), and is arranged in a center portion of the joint 18. A slot (18*a*) for inserting the heater (13) is formed in the joint tube 18. A heat radiating body (20) extended along the breather tube (11) is joined to the heater case (21). An outer peripheral portion of the breather tube (11) is covered by an insulative outer tube (24).

7 Claims, 7 Drawing Sheets

FOREIGN PATENT DOCUMENTS

| | | | | |
|---|---|---|---|---|
| EP | 001610048 | A1 | * | 12/2005 |
| EP | 001515010 | A1 | * | 7/2006 |
| JP | 61-2253 | Y2 | | 1/1986 |
| JP | 7-269326 | A | | 10/1995 |
| JP | 8151917 | A | | 6/1996 |
| JP | 2007-224739 | | * | 9/2007 |

* cited by examiner

ENGINE WITH BREATHER APPARATUS

BACKGROUND OF THE INVENTION

1. Field of the Invention

The present invention relates to an engine with a breather apparatus, and more particularly to an engine with a breather apparatus which is preferable for preventing a water from freezing within a breather passage.

2. Description of the Related Art

In a compact general-purpose engine used in an engine driven type power generator or the like, in order to introduce a blow-by gas into an intake passage, a breather tube is arranged in an outer side of an engine. Accordingly, in this type of engine, the breather tube is exposed to an outside air temperature. In a cold district in which the outside air temperature becomes significantly low, there is a possibility that a water content contained in the blow-by gas passing through the breather tube is frozen so as to close the breather tube.

As countermeasures against this problem, for example, in an engine described in Japanese Patent Application Laid-open No. 8-151917, there is attempted to heat the breather tube by introducing a discharged air passed through a cylinder, a muffler or the like corresponding to a high temperature portion during an engine operation to an outer peripheral portion of the breather tube. Further, in Japanese Utility Model Application Laid-open No. 61-2253, there is proposed a blow-by gas introduction apparatus structured such as to heat the breather tube by an electric heater.

In the apparatus described in Japanese Patent Application Laid-open No. 8-151917, since the cold air is blown at a time of starting the engine, it is not possible to obtain an effect of heating, but there is rather a possibility that the freezing of the water content is promoted by blowing the cold wind. Further, in the apparatus described in Japanese Utility Model Application Laid-open No. 61-2253, since the breather tube and a connection portion between the breather tube and the engine become considerably low temperature, a heating effect can be obtained only by using a heater having a large heat capacity. Granted that the heater having the large heat capacity is used, there is a problem that it is not easy to secure a layout space.

SUMMARY OF THE INVENTION

An object of the present invention is to provide an engine with a breather apparatus which can solve the problem mentioned above, and is preferably used for efficiently heating a gas within a breather tube.

The present invention for achieving the object mentioned above relates to an engine with a breather apparatus introducing a blow-by gas to an intake passage of an engine via a blow-by gas passage, and has the following features.

(a) The engine is provided with a breather heater arranged by being protruded into a breather tube corresponding to an external portion passing portion of an engine, in the blow-by gas passage.

(b) The breather heater is constituted by a heating element (for example, a PTC heater sealed from an external portion) and a heat radiating body, the heating element is arranged in a center portion of a horizontal cross section of the breather tube, and the heat radiating body is extended along a longitudinal direction of the breather tube.

(c) The breather tube is provided with a slot formed bypassing through a wall portion of the breather tube and used for incorporating the breather heater.

(d) The breather heater is provided with a heater case having a thermal conductivity accommodating the heating element, and one end of the heat radiating body is joined to the heater case.

(e) The heater case has an opening incorporating the heating element thereto, and a flange engaging with an inner peripheral edge of the slot is formed around the opening.

(f) The breather tube is constituted by a joint tube, and split tubes respectively connected to both ends of the joint tube, and the slot is provided in a tube wall of the joint tube.

(g) The engine is provided with a tubular heat insulator covering at least the slot in an outer periphery of the breather tube.

In accordance with the present invention, since the gas passing through the inner side of the breather tube is directly heated by the breather heater protruded into the breather tube or the like, it is hard to dissipate the heat to the ambient air via a wall of the breather tube, and it is possible to prevent water contained in the blow-by gas from being frozen within the breather tube by efficiently heating the breather tube. Further, in accordance with the feature (b), since a heat radiation area is enlarged by elongating the heat radiating body along a longitudinal direction of the breather tube, it is possible to effectively heat the blow-by gas bye longating a contact time with the gas. Further, with respect to a position in which the heating element can not be directly arranged due to a structural reason, it is possible to heat a desired portion via the heat radiating body by elongating the heat radiating body or modifying its shape.

Particularly, since the PTC heater has a self-temperature control function, it is unnecessary to control from the external controller, and it is possible to simplify the structure. Further, as is different from the case that the breather tube is heated from an outer side, it is possible to reduce a waste heat consumed for heating the breather tube itself or the like, by directly exposing the PTC heater to a flow of the blow-by gas in a sealed state. Further, the PTC heater can be protected from a corrosive gas, an oil and a water contained in the passing gas, and it is possible to efficiently heat the passing gas within the breather tube while preventing a characteristic deterioration of the PTC heater. Further, since it is possible to make a contact area between the PTC heater and the breather tube small by sealing the PTC heater, the heat capacity discharged to the ambient air via the breather tube is reduced, and it is possible to heat the gas efficiently.

In accordance with the feature (b), since the heating element is positioned in the center portion of the tube away from the wall surface of the breather tube, the heat capacity dissipated to the external portion from the heating element via the wall surface of the breather tube is reduced, so that it is possible to efficiently heat the passing gas.

In accordance with the features (c) and (d), it is possible to support the heater case by incorporating the heating element and the heat radiating body in the heater case, thereafter inserting the assembly into the breather tube from the slot, and engaging the heater case with the edge of the slot. Since the breather heater and the breather tube are brought into contact with each other in a longitudinal direction only at the engagement portion between the heater case and the slot edge, the heat capacity dissipated to the ambient air via the breather tube is reduced, and it is possible to efficiently heat the passing gas. Further, it is possible to execute a necessary maintenance by detaching the breather heater, except the cold season.

In accordance with the feature (f), since it is possible to previously incorporate the assembly of the heating element, the heat radiating body and the heater case in the joint tube, and it is possible to connect the split tubes to both ends thereof, an installation work is easily executed. Further, since it is possible to easily detach the breather heater from the breather tube together with the joint tube, it is easy to correspond to the other destination than the cold district, and it is possible to use the engine commonly regardless of the destination.

In accordance with the feature (d), it is possible to firmly support the heat radiating body by way of the heater case which can be formed by the metal having the great strength. Further, in accordance with the feature (g), it is possible to further reduce the heat capacity discharged to the ambient air via the wall of the breather tube.

DETAILED DESCRIPTION OF THE PREFERRED EMBODIMENTS

Figure 3:
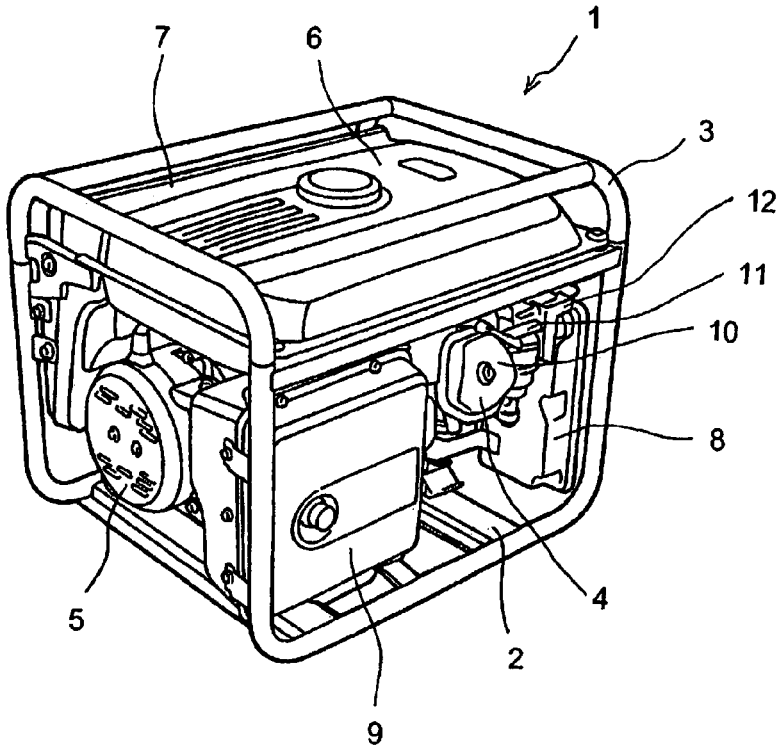
FIG. 3 is a perspective view of an engine driven type power generator with a breather apparatus in accordance with an embodiment of the present invention.

A description will be in detail given below of an embodiment in accordance with the present invention with reference to the accompanying drawings. FIG. 3 is a perspective view of an engine driven type power generator driven by an engine with a breather apparatus in accordance with an embodiment of the present invention. A power generator 1 is provided with an engine 4 accommodated in a bottom portion of a space constituted by a bottom plate 2 and a pipe-shaped frame 3, and a generator main body 5. A furl tank 6 is provided in an upper portion of the engine 4 and the generator main body 5, and a control panel 7 is arranged behind the fuel tank 6. An air cleaner 8 and a muffler 9 are arranged in adjacent to the engine 4. A breather tube 11 connecting a head cover 10 of the engine 4 and an air cleaner 8 is provided between the head cover 10 and the air cleaner 8. The breather tube 11 is passed through a support portion (a choke stay) of a choke assembly 12, one end thereof is inserted to a hole formed in the head cover 10, and the other end thereof is brought in a case of the air cleaner 8 so as to be held to a hook (not shown) in an inner portion.

Figure 4:
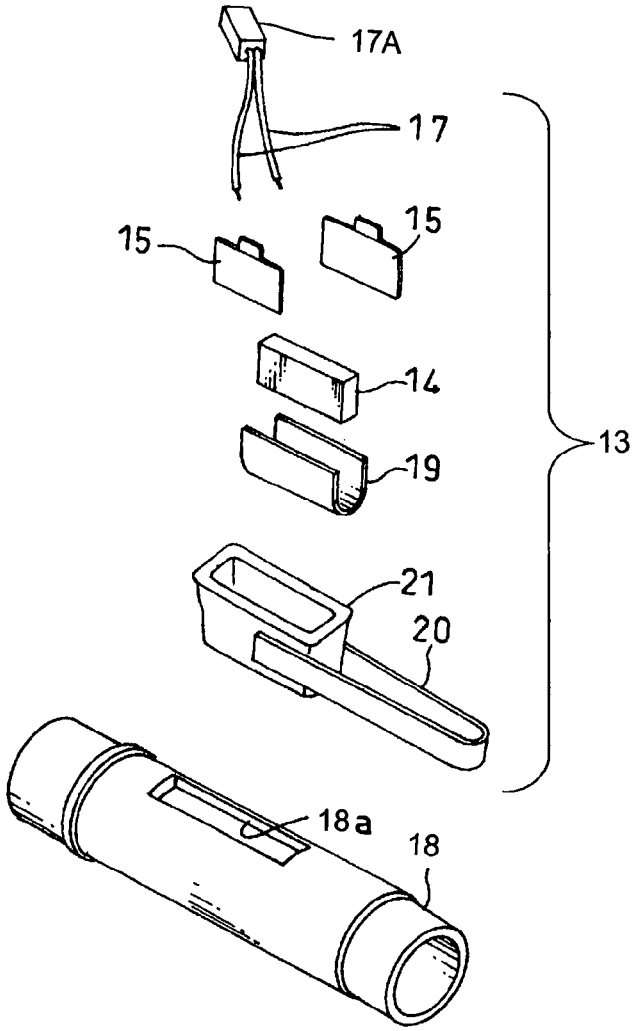
FIG. 4 is an exploded view of the breather heater.

FIG. 4 is an exploded view of a heating portion or a breather heater of the breather tube 11. In this drawing, the breather heater 13 is provided with a heating element 14, that is, a heating element, a pair of electrode plates 15 and 15 arranged in both sides of the heating element 14, and electric wires, that is, harnesses 17 and 17 connected to the electrode plates 15 and 15. The harnesses 17 and 17 are connected to a power source (not shown) by a coupler 17A. In the present embodiment, the heating element 14 employs a PTC heater corresponding to a semiconductor ceramics made of a barium titanate.

Figure 18:
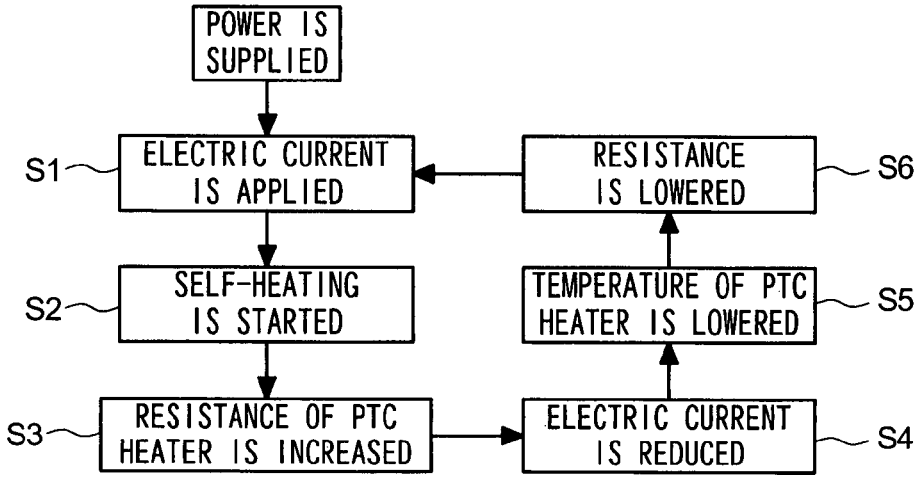
FIG. 18 is a flow chart showing a self-temperature control operation of a PTC heater.

The PTC heater suitable for the heating element 14 has the following self-temperature control operation. FIG. 18 is a view showing an operation of the PTC heater. If a power is supplied, an electric current is applied (a stage Si), and a self-heating is started (a stage S2). As a result, a resistance of the PTC heater is increased (a stage S3), and the electric current is reduced (a stage S4). If the electric current is reduced, a temperature of the PTC heater is lowered (a stage S5), and the resistance is lowered (a stage S6). If the resistance is lowered, the electric current is increased. In other words, the stage goes back to the stage S1. These stages are repeated as mentioned above, and the temperature of the PTC heater is maintained constant in accordance with a temperature-resistance characteristic of the PTC heater. By using the PTC heater having the self-temperature control operation as mentioned above, a complicated temperature control means is not necessary, and it is possible to simplify a heating structure.

Referring to FIG. 4 again, the heating element 14 is inserted to a case 21 having a heat radiating body 20 together with an electrical insulating sheet 19 arranged in an outer side of the electrode plates 15 and 15 to which the harnesses 17 and 17 are connected, is adhered by filling a mold material having a good thermal conductivity therein, and is sealed from an external portion. The heating element 14 integrally molded with the case 21 is inserted to a joint tube 18 from a slot 18*a* formed in the joint tube 18 together with the heat radiating body 20, and the case 21 and the joint tube 18 are firmly attached with an adhesive agent. The joint tube 18 corresponds to a tubular member arranged in the middle of two split breather tubes 11 so as to connect the two split breather tubes 11 with each other. An assembly of the breather tube 13 is finished by connecting the joint tube 18 to the breather tube 11 via a split tube mentioned below.

Figure 5:
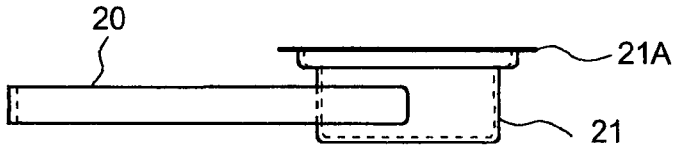
FIG. 5 is a side elevational view showing an assembly of a case accommodating a heating element and a heat radiating body.
Figure 6:
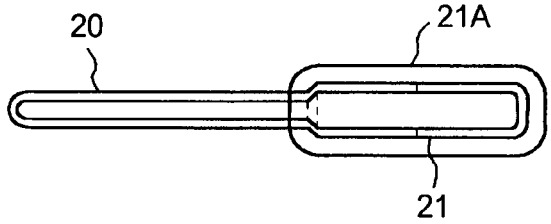
FIG. 6 is a bottom elevational view showing the assembly of the case accommodating the heating element and the heat radiating body.

FIG. 5 is a side elevational view of an assembly of the case 21 accommodating the heating element and the heat radiating body 20, and FIG. 6 is a bottom elevational view of the same. The case 21 corresponds to an approximately rectangular parallele piped container having one open surface. An edge of the open surface is provided with a flange 21A engaging with an edge of the slot 18*a* of the joint tube 18. It is preferable that the heater case 21 is constituted by a deep draw formed product made of a metal having a good heat conductivity such as a copper, a brass, an aluminum or the like. The heat radiating body 20 is formed by folding the same metal as the heater case 21 into two and joining both ends to two side surfaces of the heater case 21. It is preferable that this joining is achieved by a welding or abrazing. The heat radiating body 20 is not limited to the two-folded metal plate, but may be constituted by a rod-like member or a linear member as mentioned below with reference to FIG. 11. However, in order to improve the heat radiation, it is preferable to employ such a shape that can secure a wide surface area. In this case, it is preferable that an area of a joint root portion with the heater case 21 is wider, however, it is preferable to employ such a shape that the heat can be efficiently conducted to a leading end portion.

Figure 7:
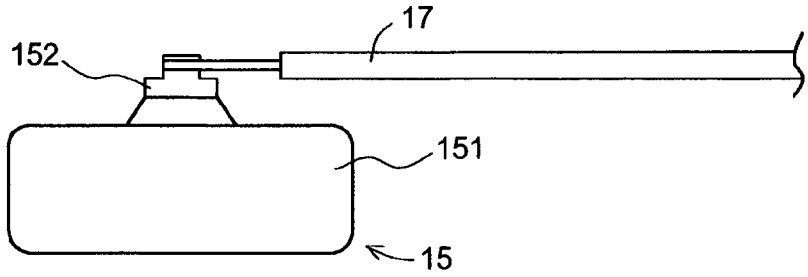
FIG. 7 is a side elevational view of an assembly of an electrode plate and a harness.
Figure 8:
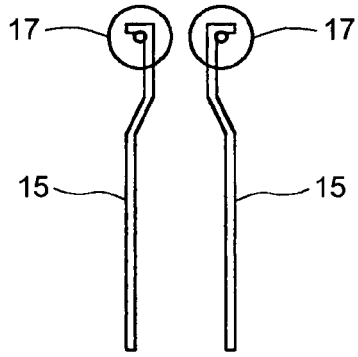
FIG. 8 is a front elevational view of the assembly of the electrode plate and the harness.

FIG. 7 is a side elevational view of an assembly of the electrode plate 15 and the harness 17, and FIG. 8 is a front elevational view of the same. The electrode plate 15 is constituted by an electrode plate main body 151 brought into contact with a side surface of the heating element 14 and a connection portion 152 formed in an upper portion of the electrode plate main body 151, and the harness 17 is connected to the connection portion 152. Since a pair of connection portions 152 and the electrode plate main bodies 151 are in adjacent to each other as mentioned above, it is preferable to set an insulating member electrically insulating between the connection portions 152 and between both the electrode plate main bodies 151.

Figure 9:
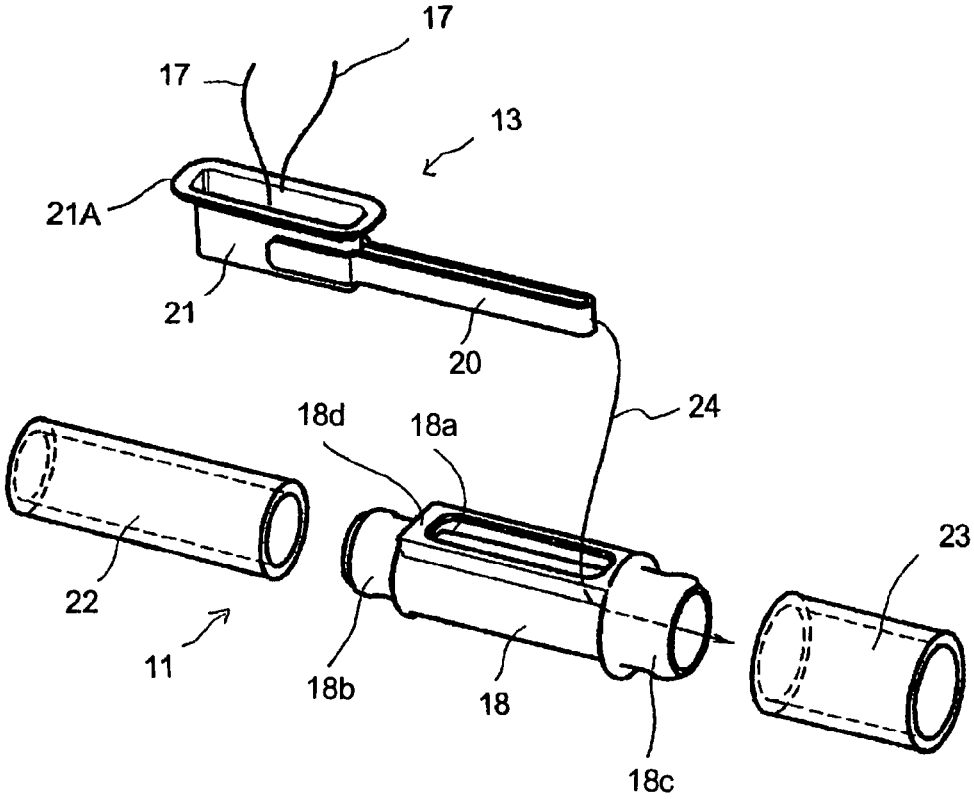
FIG. 9 is a perspective view showing a assembling step of the breather heater and the breather tube.

FIG. 9 is a perspective view of the breather heater 13 and the breather tube 11 showing an installation step of the breather heater 13. The breather tube 11 is constituted by the joint tube 18 and split tubes 22 and 23 fitted to small-diameter portions 18*b* and 18*c* in both ends of the joint tube 18. It is preferable that the joint tube 18 is made of a nylon or the like which has a suitable heat insulating property and to which a water droplet is hard to be attached, and it is preferable that the split tubes 22 and 23 are made of a rubber so as to be easily fitted to the connection portion to the air cleaner 8 and the head cover 10 of the engine.

It is preferable that a seat surface 18*d* is formed in a flat surface shape in the middle portion of the joint tube 18 in such a manner that the flange 21A of the case 21 can seat thereon. The slot 18*a* is formed in the seat surface 18*d* in such a manner as to extend along a longitudinal direction of the joint tube 18. The breather heater 13 including the heat radiating body 20 and the case 21 is inserted to the joint tube 18 from a leading end side of the heat radiating body 20 along a path 24 by utilizing the slot 18*a* so as to be positioned in such a manner that an edge of the upper open portion of the case 21, that is, the flange 21A seat on the seat surface 18*d*. As mentioned above, the heating element 14 is arranged in a center portion of a horizontal cross section of the joint tube 18, and the heat radiating body 20 is arranged in a state of extending along the longitudinal direction of the joint tube 18. The layout of the heating element 14 and the heat radiating body 20 will be further described later.

After installing the breather heater 13 to the joint tube 18, the split tubes 22 and 23 are fitted to the joint tube 18. Both ends of the assembly of the breather heater 13 and the breather tube 11 assembled as mentioned above are respectively connected to the air cleaner 8 and the head cover 10 of the engine.

Figure 1:
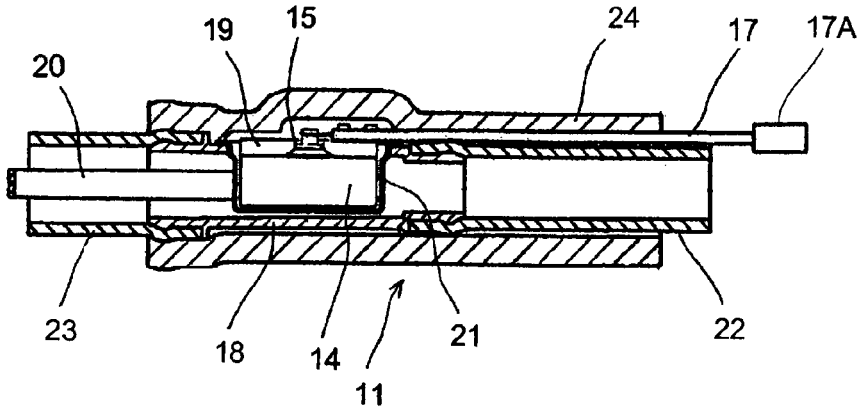
FIG. 1 is a side elevational cross sectional view of a breather tube accommodating a breather heater in accordance with an embodiment of the present invention.
Figure 2:
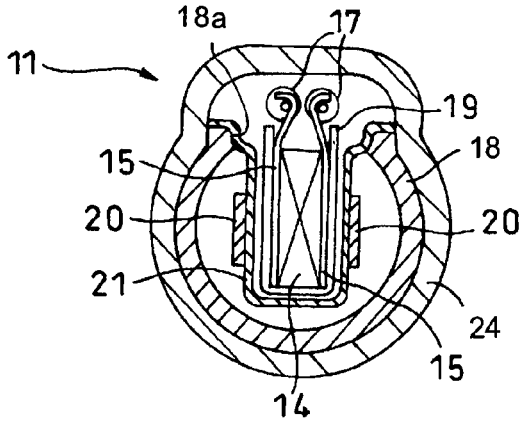
FIG. 2 is a front elevational cross sectional view of the breather tube accommodating the breather heater in accordance with the embodiment of the present invention.

FIG. 1 is a side elevational cross sectional view of a breather tube in which the breather heater 13 is incorporated, and FIG. 2 is a front elevational cross sectional view of the same. The same reference numerals in FIGS. 4 and 8 denote the same or similar portions. In the example in FIG. 1, the joint tube 18 does not have the seat surface. In FIG. 1, a part of the breather tube 11 is constituted by a tube portion (one split tube) 23 connected to the air cleaner 8, a tube portion (the other split tube) 22 connected to the head cover 10, and the joint tube 18 arranged between both the tube portions 22 and 23 and connecting the both. The heating element 14 and the heat radiating body 20 extended in an axial direction of the joint tube 18 from the heating element 14 are accommodated within the joint tube 18. The harness 17 is drawn out to an external portion of the joint tube 18 from the heating element 14, and is extended in a longitudinal direction of the joint tube 18. The tube portion 23 is fitted so as to be connected to one end (in the side to which the heat radiating body 20 is extended) of the joint tube 18, and the tube portion 22 is fitted so as to be connected to the other end of the joint tube 18. The connection portion to the joint tube 18 in which the tube portions 22 and 23 and the heating element 14 are incorporated is covered by an outer tube 24 made of a heat insulating material. The outer tube 24 does not necessarily cover an entire of the connection portion, but may cover at least the slot 18*a*.

Figure 10:
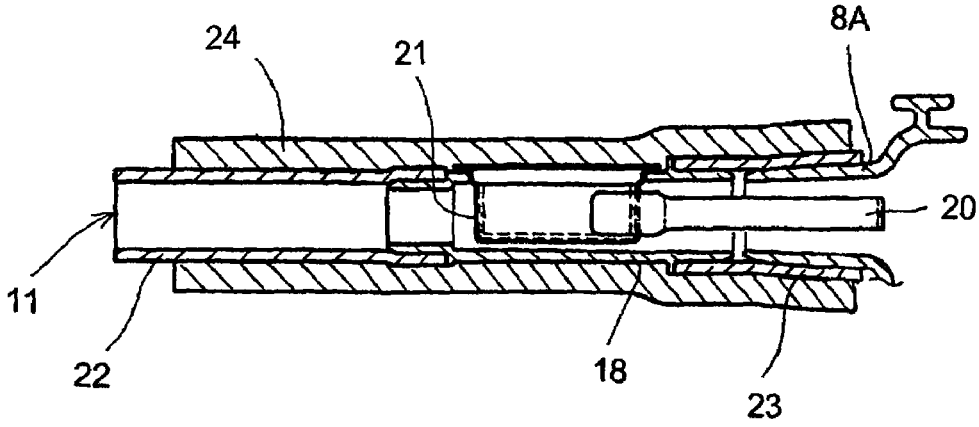
FIG. 10 is a side elevational cross sectional view of a breather tube accommodating a breather heater in accordance with an embodiment of the present invention.
Figure 11:
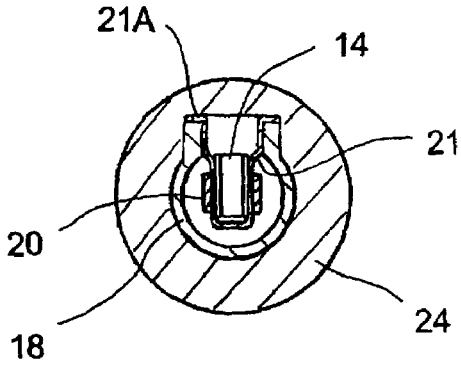
FIG. 11 is a front elevational cross sectional view of the breather tube accommodating the breather heater in accordance with the embodiment of the present invention.

FIG. 10 is a side elevation cross sectional view of a breather tube including a joint tube having a seat surface in which the breather heater 13 is incorporated, and FIG. 11 is a front elevational cross sectional view of the same. The same reference numerals as those in FIGS. 1 and 9 denote the same or similar portions. In FIG. 10, the split tube 23 of the breather tube 11 is fitted to a blow-by gas receiving port 8A corresponding to a tubular protruding portion formed in the air cleaner 8. The receiving port 8A is provided by being branched from an intake pipe of the air cleaner 8. The breather heater 13 is structured such that the flange 21A of the case 21 is supported to an edge of the slot 18*a* so as to be arranged in such a manner as to protrude to a center portion in a transverse section of the joint tube 18, as is understood from FIG. 10. The heat radiating body 20 joined to the case 21 is arranged along the longitudinal direction of the breather tube 11, and a leading end thereof extends to a root portion of the blow-by gas receiving port 8A. The breather tube 11 is covered by an outer tube 24 made of a heat insulating material. It is preferable that the outer tube 24 covers an entire of the breather tube 11, however, it is sufficient that the outer tube 24 covers at least a connection portion to the joint tube 18 in which the split tubes 22 and 23 and the heating element 14 are incorporated as illustrated. The upper open portion of the case 21 of the breather heater 13 is shielded from the external environment by the outer tube 24, and an inner side of the breather tube 11 is heat insulated from a low-temperature environment in the external portion.

In accordance with the structures shown in FIGS. 1 and 2, and FIGS. 10 and 11, since the assembly can be formed by previously assembling the breather heater 13 in the joint tube 18 and the assembly can be connected to the split tubes 22 and 23 in the additional step, it is easy to install the breather heater 13 to the engine driven type power generator.

Figure 12:
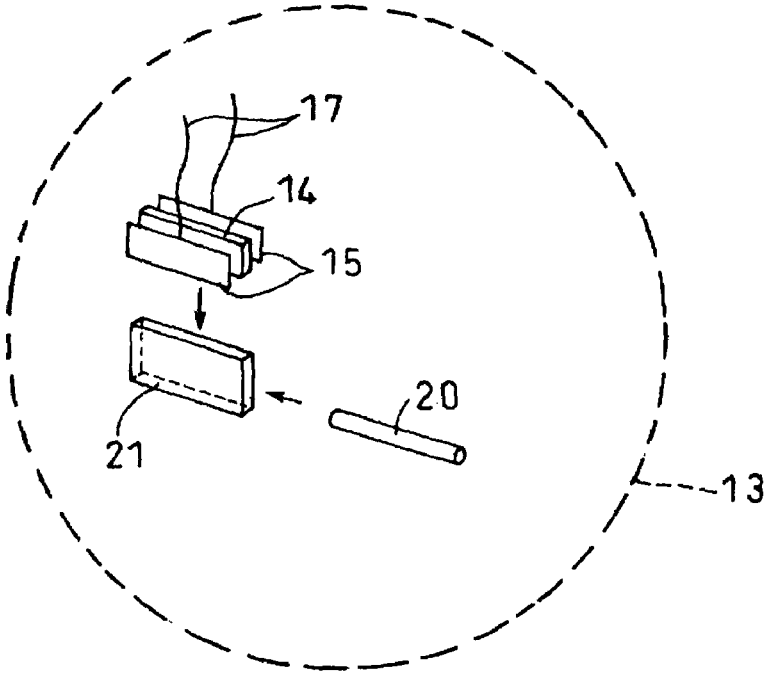
FIG. 12 is an exploded view of the breather heater.

FIG. 12 is an exploded view of a heating portion of a breather tube 11, that is, a breather heater in accordance with a second embodiment, and the same reference numerals as those of FIG. 4 denote the same or similar portions. In the drawing, the breather heater 13 is provided with a heating element (desirably constituted by a PTC heater corresponding to a semiconductor ceramics made of a barium titanate) 14, a pair of electrode plates 15 and 15 arranged in both sides of the heating element 14, and electric wires 17 and 17 connected to the electrode plates 15 and 15. The electric wires 17 and 17 are connected to a power source (not shown).

The heating element 14 is inserted to the heater case 21 in a state of being pinched by the electrode plates 15 and 15 to which the electric wires 17 and 17 are connected, in a side surface, and is adhered by filling a mold material therein. A tubular or rod-shaped heat radiating body 20 is joined to the heater case 21. The heating element 14 is isolated from a gas flowing within the breather tube 11 by the heater case 21. It is preferable that the heater case 21 is constituted by a deep draw formed product made of the metal having the good thermal conductivity such as the copper, the braze, the aluminum or the like in the same manner as the heater case 21 shown in FIG. 5. In this case, as is different from the structure shown in FIG. 5, the heart case 21 does not have the flange 21A. In the case that the heater case 21 is made of the metal, the insulation is achieved in the same manner as shown in FIG. 4, by arranging an electrical insulating sheet or the like between the electrodes 15 and 15.

Figure 13:
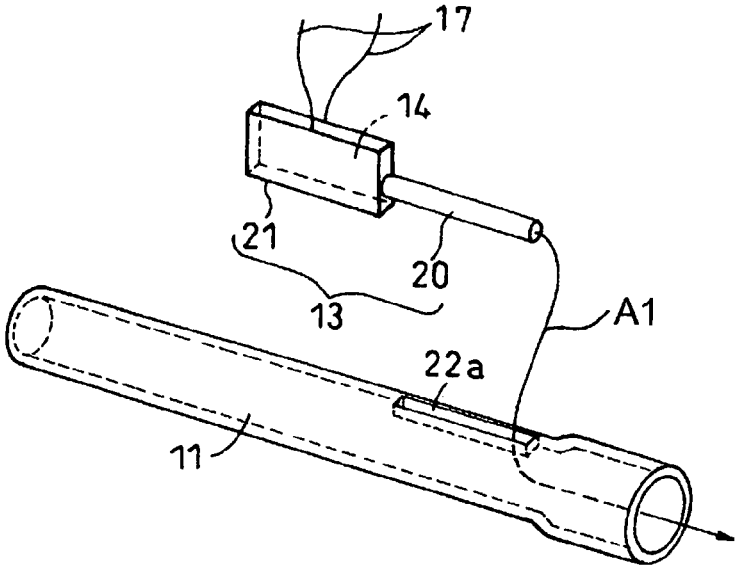
FIG. 13 is a perspective view for explaining an operation of assembling the breather heater in the breather tube.

FIG. 13 is a perspective view for explaining an operation of assembling the breather heater 13 in the breather tube 11 using no joint tube. The breather tube 11 has a slot 22*a* extending along a longitudinal direction thereof, and the heating element 14 integrally molded with the heater case 21 is inserted into the breather tube 11 through the slot 22*a* together with the heat radiating body 20. The breather heater 13 inserted into the breather tube 11 is fixed to the breather tube 11 by adhering a portion around an upper edge of the heater case 21 to an inner periphery of the slot 22*a*. An arrow Al denotes an insertion direction of the breather heater 13.

Figure 14:
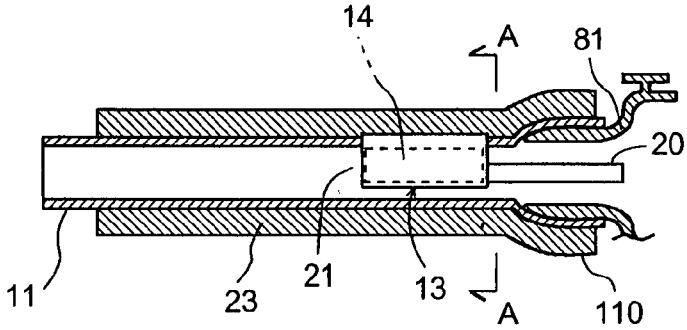
FIG. 14 is a side elevational cross sectional view of a breather tube accommodating a breather heater in accordance with an embodiment of the present invention.
Figure 15:
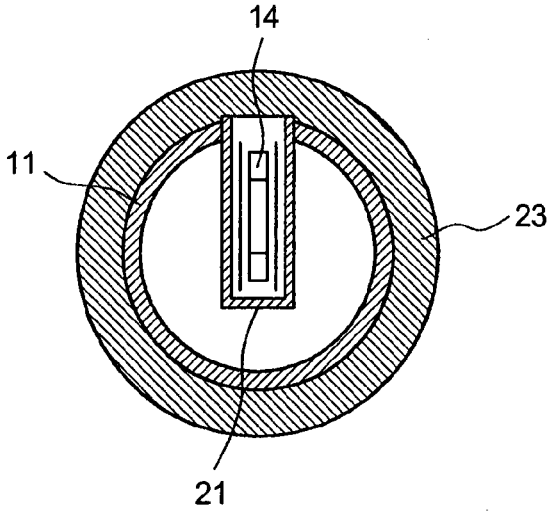
FIG. 15 is a cross sectional view taken along a line A-A in FIG. 14.

FIG. 14 is a cross sectional view showing a structure of a mounting portion between the breather tube to which the breather heater is incorporated and the air cleaner, and FIG. 15 is a cross sectional taken along a line A-A in FIG. 14. In these drawings, an outer periphery of the breather tube 11 is provided with a tubular heat insulating body 23 covering the slot 22*a* to which the breather heater 13 is inserted, and suppressing a heat dissipation to the external portion from the breather tube 11. The heat insulating body 23 has a heat dissipation control effect as far as it has a dimension at least covered by the slot 22*a*, however, a greater effect can be obtained by covering over a wide range of an easily cooled portion near the air cleaner mounting portion.

One ends 110 of the breather tube 11 are expanded in such a manner as to comply with an outer shape of a receiving port 81 formed as a part of the air cleaner 8, are fitted to each other. Further, as illustrated, the heat radiating body 20 extending from the heating element 14 of the breather heater 13 is positioned in a center of the receiving port 81 provided so as to be branched from an intake pipe of the air cleaner 8.

Figure 16:
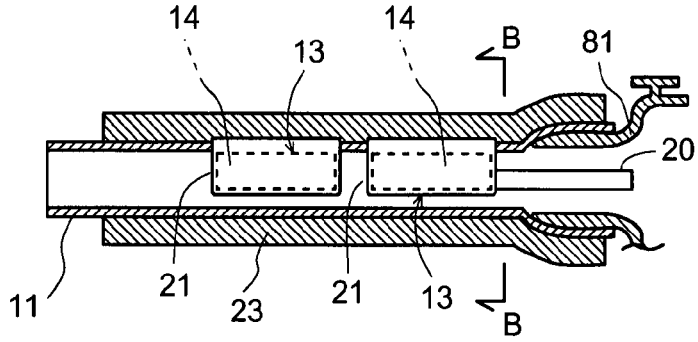
FIG. 16 is a side elevational cross sectional view of a breather tube accommodating a plurality of breather heaters.
Figure 17:
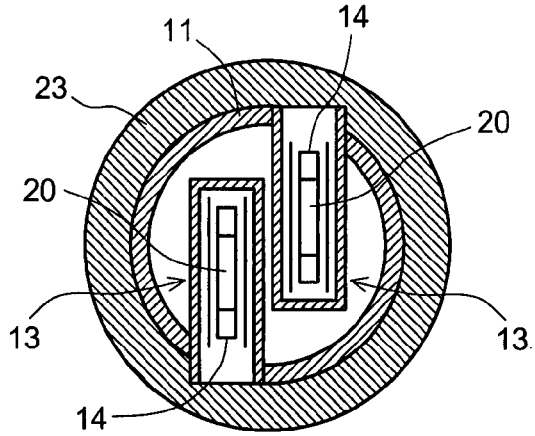
FIG. 17 is a cross sectional view taken along a line B-B in FIG. 16.

The number of the breather heater 13 is not limited to one, but a plurality of breather heaters may be provided. FIG. 16 is a cross sectional view of a breather tube having a plurality of breather heaters, and FIG. 17 is a cross sectional view taken along a line B-B in FIG. 16. The same reference numerals as those in FIG. 12 denote the same or similar portions. In this structure, two breather heaters 13 and 13 are arranged in the breather tube 11 side by side in a longitudinal direction of the tube 11. In other words, they are arranged in series along a flow of the blow-by gas. Further, two breather heaters 13 are arranged symmetrically in a center of a transverse section of the breather tube 11.

The breather tube 11 in accordance with the second embodiment may be formed as the split type in the same manner as shown in FIG. 1 for being easily assembled.

Figure 19:
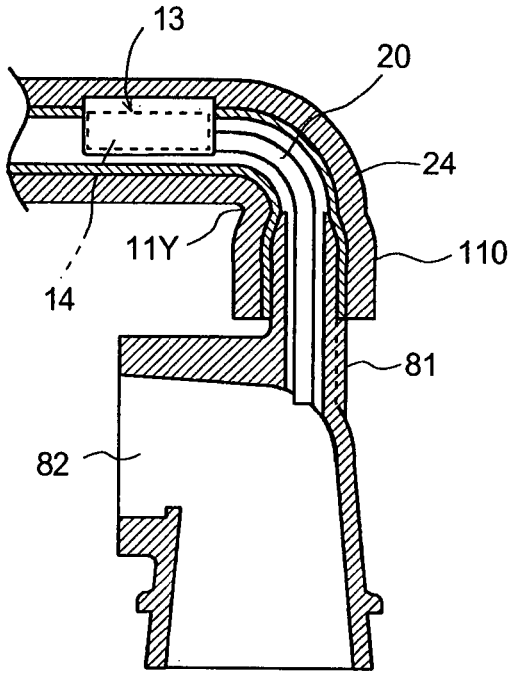
FIG. 19 is a cross sectional view showing a modified embodiment of a mounting portion between an air cleaner and a breather tube.

FIG. 19 is a cross sectional view showing a modified embodiment of the mounting portion to the air cleaner 8. There is a case that the breather heater 13 can not be attached to the portion near the receiving port 81 in some layout of the air cleaner 8 or the position and the direction of the intake pipe 82 provided in the air cleaner 8. The structure in FIG. 13 corresponds to an application example in the case mentioned above. In this example, there is employed a layout in which one end 110 of the tube connected to the receiving port 81 is bent at 90 degree just near the receiving port 81 so as to reach the head cover. Accordingly, the breather heater 13 is positioned in front of a bent portion 11Y of the breather tube 11 as seen from the air cleaner 8 side. In this layout, the heat radiating body 20 is bent along the bent portion 11Y so as to be extended to the intake pipe 82, in such a manner as to heat the receiving port 81.

Figure 20:
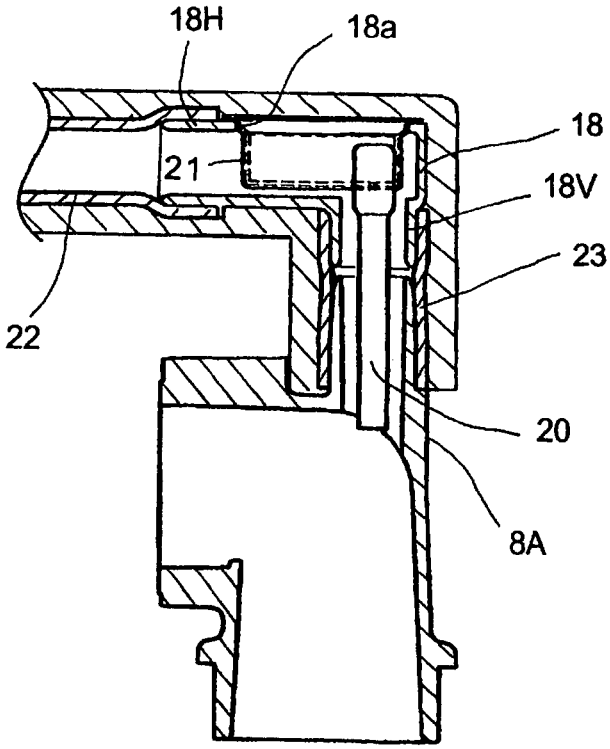
FIG. 20 is a cross sectional view showing a modified embodiment of a mounting portion between an air cleaner and a breather tube.

FIG. 20 is a cross sectional view showing a further modified embodiment of the mounting portion to the air cleaner 8. In some layout of the air cleaner 8, there is a case that the joint tube 18 can not be linearly arranged in a leading end extension direction of the blow-by gas receiving port 8A. Accordingly, in this modified embodiment, the joint tube 18 is formed in an elbow shape, that is, formed as a curved pipe.

The breather heater 13 is inserted to an inner side from the slot 18*a* formed in a horizontal portion 18H of the elbow-shaped joint tube 18. The heat radiating body 20 is bonded to a side orthogonal to the longitudinal direction of the case 21, that is, to a bottom surface of the case 21 orthogonally, so as to be extendable to the blow-by gas receiving port 8A from a vertical portion 18V of the joint tube 18. The vertical portion 18V of the breather tube 11 and the blow-by gas receiving port 8A are connected by the split tube 23, and the horizontal portion 18H of the joint tube 18 is coupled to the split tube 22.

As mentioned above, it is possible to optionally heat the position via the heat radiating body 20 extended along the breather tube 11 by appropriately selecting the shape and the dimension of the heat radiating body 20 extended from the breather heater 13, and the extending direction thereof, even if the heating element 14 of the breather heater 13 can not be provided at a desired position to be heated.

The present invention is not limited to the embodiments mentioned above, but may be applied to any structure as far as the breather heater is arranged within the breather tube corresponding to an external portion passing portion of the engine.

For example, the heat radiating body 20 is provided for enlarging the heat dissipation area, however, the present invention is not limited to this, but can include the engine to which the breather heater having no heat radiating body 20 is applied.

What is claimed is:

1. An engine with a breather apparatus introducing a blow-by gas to an intake passage of an engine via a blow-by gas passage, comprising;

a breather heater provided within a breather tube of a blow-by gas passage corresponding to an external portion passing portion of the engine, wherein the breather tube has a slot formed by passing through a wall portion of the breather tube, and the breather heater is incorporated into the breather tube by passing through the slot from outside of the breather tube so as to protrude into a blow-by gas passing cavity formed within the breather tube, wherein the breather heater is provided with a heater case formed of a thermally conductive material accommodating a heating element, and one end of a heat radiating body is joined to the heater case, and wherein the engine is provided with a tubular heat insulator covering at least the slot in an outer periphery of the breather tube.

2. The engine with a breather apparatus as claimed in claim 1, wherein the heating element is arranged in a center portion of a horizontal cross section of the breather tube, and the heat radiating body is extended along a longitudinal direction of the breather tube.

3. The engine with a breather apparatus as claimed in any one of claims 1 or 2, wherein the breather tube is constituted by a joint tube, and split tubes respectively connected to both ends of the joint tube, and the slot is provided in a tube wall of the joint tube.

4. The engine with a breather apparatus as claimed in claim 3, wherein the heating element is constituted by a PTC heater, wherein the breather tube is constituted by a joint tube, and split tubes respectively connected to both ends of the joint tube, and the slot is provided in a tube wall of the joint tube, wherein the heating element is constituted by a PTC heater.

5. The engine with a breather apparatus as claimed in claim 1, wherein the heater case has an opening incorporating the heating element thereto, and a flange formed around the opening engaging with an inner peripheral edge of a slot formed by passing through a wall portion of the breather tube.

6. The engine with a breather apparatus as claimed in any of claims 2 or 5, wherein the heating element is constituted by a PTC heater.

7. The engine with a breather apparatus as claimed in claim 6, wherein the PTC heater is sealed from an external portion.

* * * * *